US005622132A

United States Patent [19]

Mardikian

[11] Patent Number: 5,622,132

[45] Date of Patent: Apr. 22, 1997

[54] SHOCK-ABSORBING STEERING SYSTEM FOR PERSONAL WATERCRAFT

[75] Inventor: Albert Mardikian, Corona Del Mar, Calif.

[73] Assignee: Mardikian 1991 Irrevocable Trust, Corona Del Mar, Calif.

[21] Appl. No.: 580,807

[22] Filed: Dec. 29, 1995

[51] Int. Cl.[6] ..... B63B 35/00

[52] U.S. Cl. ..... 114/144 R; 114/270

[58] Field of Search ..... 74/551.2, 551.1, 74/551.3, 551.4, 551.5; 280/276; 114/144 R, 270; 440/38, 41, 42

[56] References Cited

U.S. PATENT DOCUMENTS

| | | | |
|---|---|---|---|
| 2,561,156 | 7/1951 | Thorkildsen | 280/276 |
| 3,936,076 | 2/1976 | Probst | 280/276 |
| 4,726,311 | 2/1988 | Niina | 114/270 |
| 5,092,260 | 3/1992 | Mardikian | 114/285 |
| 5,103,754 | 4/1992 | Fujitisubo | 114/270 |
| 5,113,777 | 5/1992 | Kobayashi | 114/270 |
| 5,201,244 | 4/1993 | Stewart et al. | 74/551.1 |
| 5,257,552 | 11/1993 | Boyer et al. | 74/551.1 |
| 5,309,861 | 5/1994 | Mardikian | 114/363 |
| 5,367,978 | 11/1994 | Mardikian | 114/363 |
| 5,427,049 | 6/1995 | Mardikian | 114/343 |
| 5,465,679 | 11/1995 | Mardikian | 114/363 |

FOREIGN PATENT DOCUMENTS

| | | | |
|---|---|---|---|
| 197528A | 10/1986 | European Pat. Off. | 114/270 |
| 550313 | 3/1923 | France | 74/551.2 |
| 626014 | 4/1927 | France | 74/551.2 |
| 347067 | 4/1931 | United Kingdom | 74/551.2 |

*Primary Examiner*—Edwin L. Swinehart
*Attorney, Agent, or Firm*—Klein & Szekeres, LLP

[57] ABSTRACT

An improved steering assembly for personal watercraft governs the positioning of a steering nozzle through a cable affixed to a steering shaft attached to handlebars gripped by the rider/operator of the watercraft. The steering shaft is mounted to the hull in a retainer member relative to which it is rotatable. The handlebars are shielded from the shocks and bumps occurring while the watercraft travels on rough water by a shock absorber that is mounted between the retainer member and the handlebars. The improved steering assembly significantly increases riding comfort and reduces operator fatigue.

22 Claims, 5 Drawing Sheets

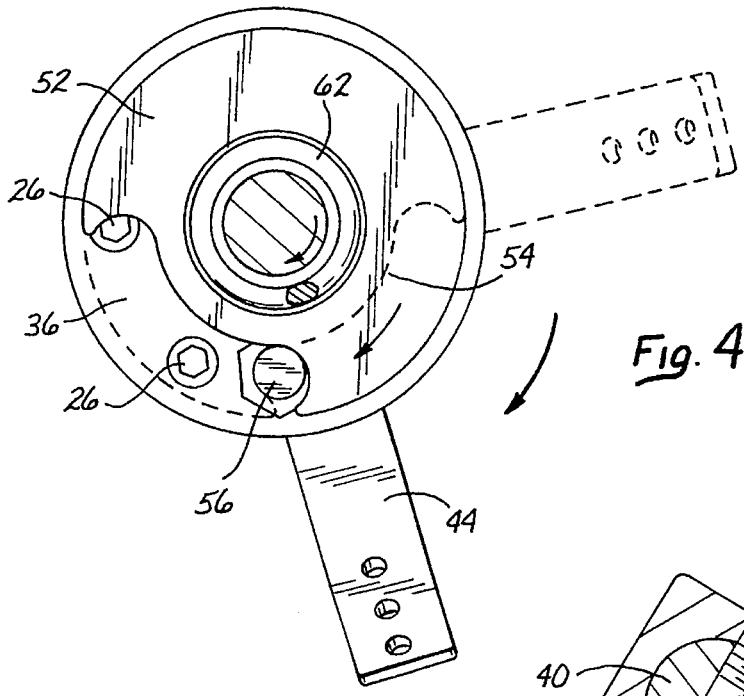
Fig. 4
Fig. 5
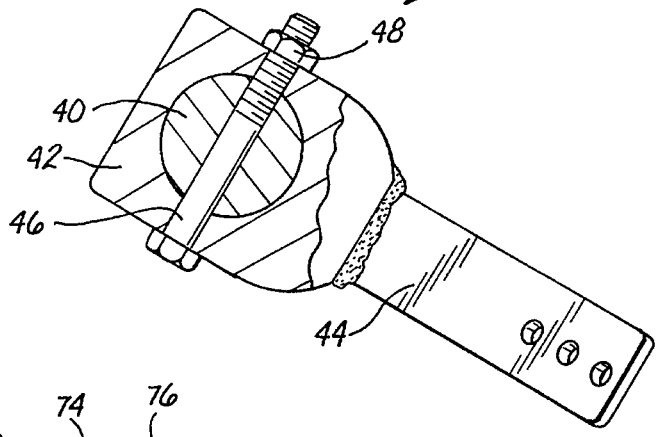
Fig. 10
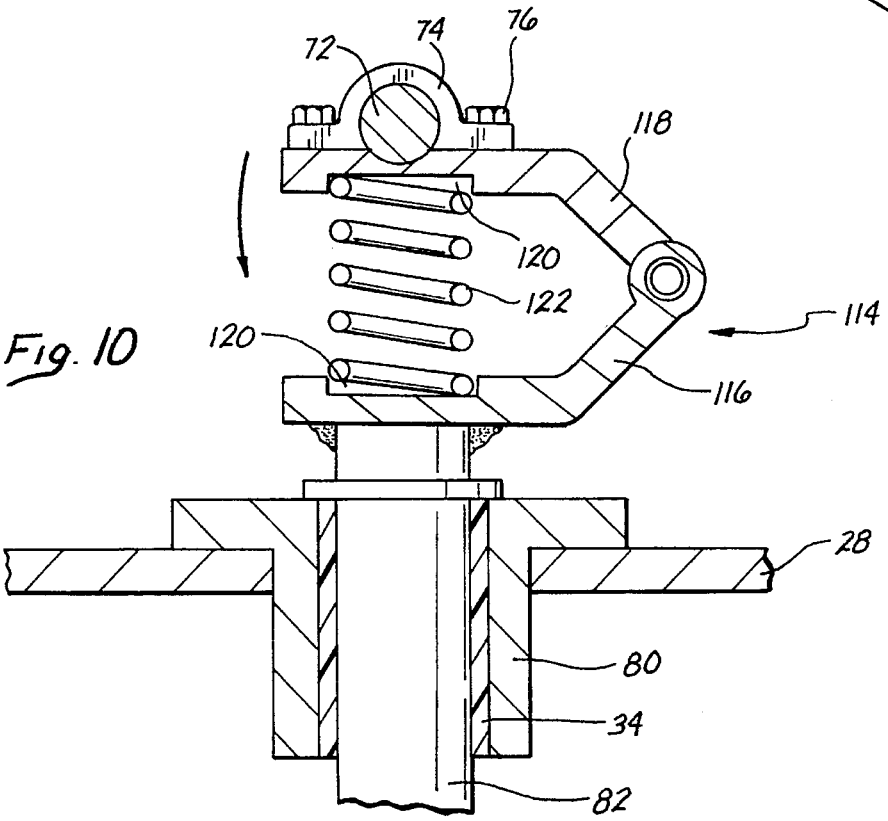

SHOCK-ABSORBING STEERING SYSTEM FOR PERSONAL WATERCRAFT

BACKGROUND OF THE INVENTION

1. Field of the Invention

The present invention is directed to an improved steering system for personal watercraft, and particularly to an improved shock-absorbing steering system for personal watercraft.

2. Brief Description of the Prior Art

Personal watercraft are well known in the art. Such craft typically employs a jet pump for generating a rearwardly directed stream of water which provides the forward thrust required to propel the craft and its occupant. Steering of the personal watercraft is accomplished by controlling the direction of thrust or propulsion that drives the craft. The direction of thrust or propulsion is, in turn, controlled by the positioning of a movable steering nozzle which receives the stream of water from the jet pump and directs the flow so as to divide the thrust into the desired directional components. The positioning of the nozzle is affected by a steering cable system which connects the nozzle to a handlebar held and controlled by the driver of the watercraft. The handlebar typically includes a throttle control and an electrical on and off switch.

As far as the arrangement for accommodating the driver/occupant of the personal watercraft is concerned, one type of personal watercraft requires the occupant to stand on the watercraft while riding. This type of watercraft is also commonly known as a "jet ski". Although jet skis of this type are popular, a related sit-down type of personal watercraft has also recently gained great popularity. Such "sit-down" models include a seat which the driver usually occupies in sitting reclined or semi-prone position to drive the watercraft. It is well known that "stand-up" jet skis, as well the related "sit-down" models tend to be driven fast on the water. Therefore, the occupants of such watercraft are subjected to substantial shocks and bumps as the rapidly traveling watercraft meets the waves. It is well known that the shocks and bumps that the rider of a personal watercraft experiences while riding on rough water cause substantial discomfort to most riders, and shorten the time for which most riders are capable of enjoying travel with the watercraft. For these reasons, several improvements have been made in the prior art to protect the rider from the shocks and bumps experienced while riding on rough water. U.S. Pat. Nos. 5,309,861 and 5,367,978 describe shock absorber mounted seats for personal watercraft, and U.S. Pat. No. 5,465,679 describes a shock absorbing floorboard for personal watercraft. Still other improvements pertaining to personal watercraft can be found in U.S. Pat. No. 5,092,260 and 5,427,049. U.S. Pat. No. 5,092,260 describes a personal watercraft that has an adjustable flap on the bottom of the craft, so that the angle at which the flap meets the water is controllable by the operator of the craft. The flap can also serve as a brake. U.S. Pat. No. 5,427,049 describes a self-retracting step assembly that facilitates mounting or remounting the personal watercraft from the water. The present invention fills a need in the prior art for a shock absorbing steering assembly that improves the comfort of riding a personal watercraft.

SUMMARY OF THE INVENTION

It is an object of the present invention to provide a personal watercraft which allows its occupant to travel on the watercraft in increased comfort.

It is another object of the present invention to provide a personal watercraft which is less fatiguing to ride in rough water and therefore can be enjoyably ridden for longer periods of time.

It is still another object of the present invention to provide a personal watercraft which has a shock absorbing steering assembly that cushions the handlebars or steering wheel against shocks and bumps caused by riding on rough water.

It is yet another object of the present invention to provide an improved steering assembly for personal watercraft and boats which travel fast on the water.

The foregoing and other objects and advantages are attained by an improved steering assembly in a jet-pump driven watercraft that is steered by a movable steering nozzle which ejects water of the jet pump to provide thrust or propulsion to the watercraft. The steering assembly is connected to the nozzle by a cable that controls the position of the nozzle. The improvement in the steering assembly comprises force or shock absorbing means mounted between a member fixedly attached to the deck of the craft and the handlebars or steering wheel to act on a steering shaft which is mounted for limited pivoting and also for limited longitudinal motion relative to the fixedly attached member. The deck of the craft can, of course, be considered as part of the hull, since the deck itself is rigidly attached to the hull. Position of the cable and thereby the positioning of the steering nozzle is controlled by the handlebars or steering wheel to which the cable is indirectly attached. Shocks and bumps while riding on water are absorbed by the shock absorbing means that allow limited longitudinal travel of the steering shaft.

The features of the present invention can be best understood together with further objects and advantages, by reference to the following description, taken in connection with the accompanying drawings, wherein like numerals indicate like parts.

BRIEF DESCRIPTION OF THE DRAWINGS

FIG. 4 is a cross-sectional view taken on lines 4,4 of FIG. 2;

FIG. 5 is a cross-sectional view taken on lines 5,5 of FIG. 2;

FIG. 10 is a partial side view, partly in cross section, of a fourth preferred embodiment of the steering assembly of the present invention.

DESCRIPTION OF THE PREFERRED EMBODIMENTS

Figure 1:
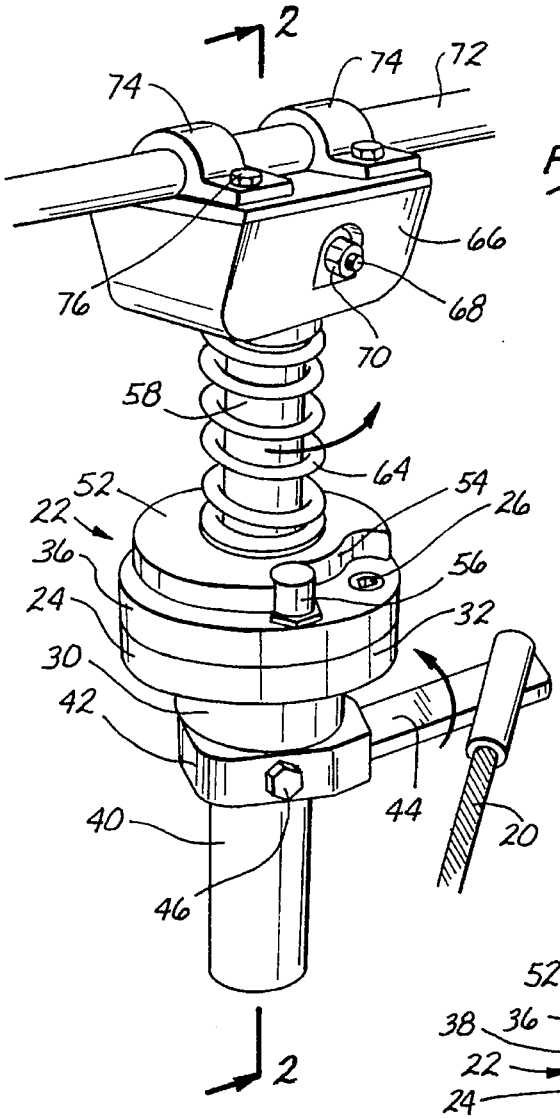
FIG. 1 is a perspective view showing the first preferred embodiment of the steering assembly of the present invention.
Figure 2:
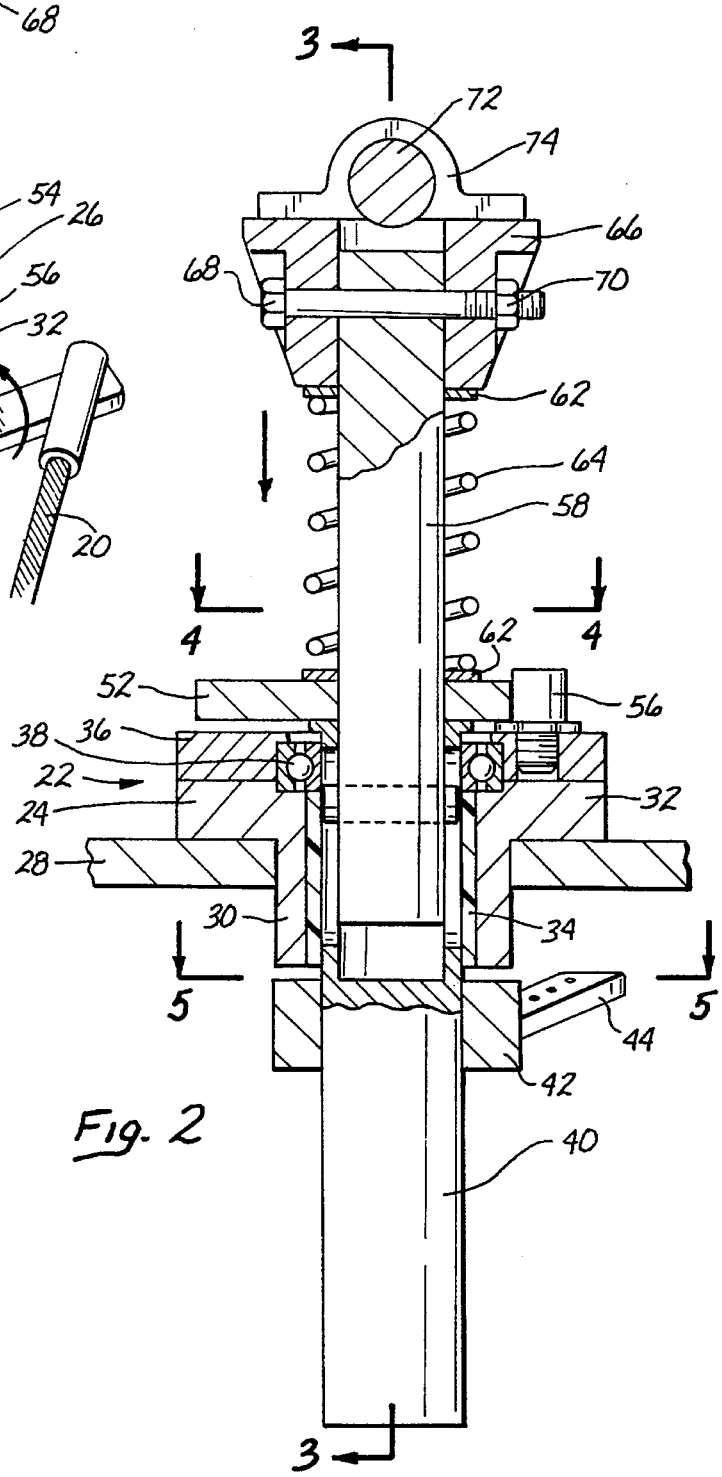
FIG. 2 is a cross-sectional view taken on lines 2,2 of FIG. 1.
Figure 3:
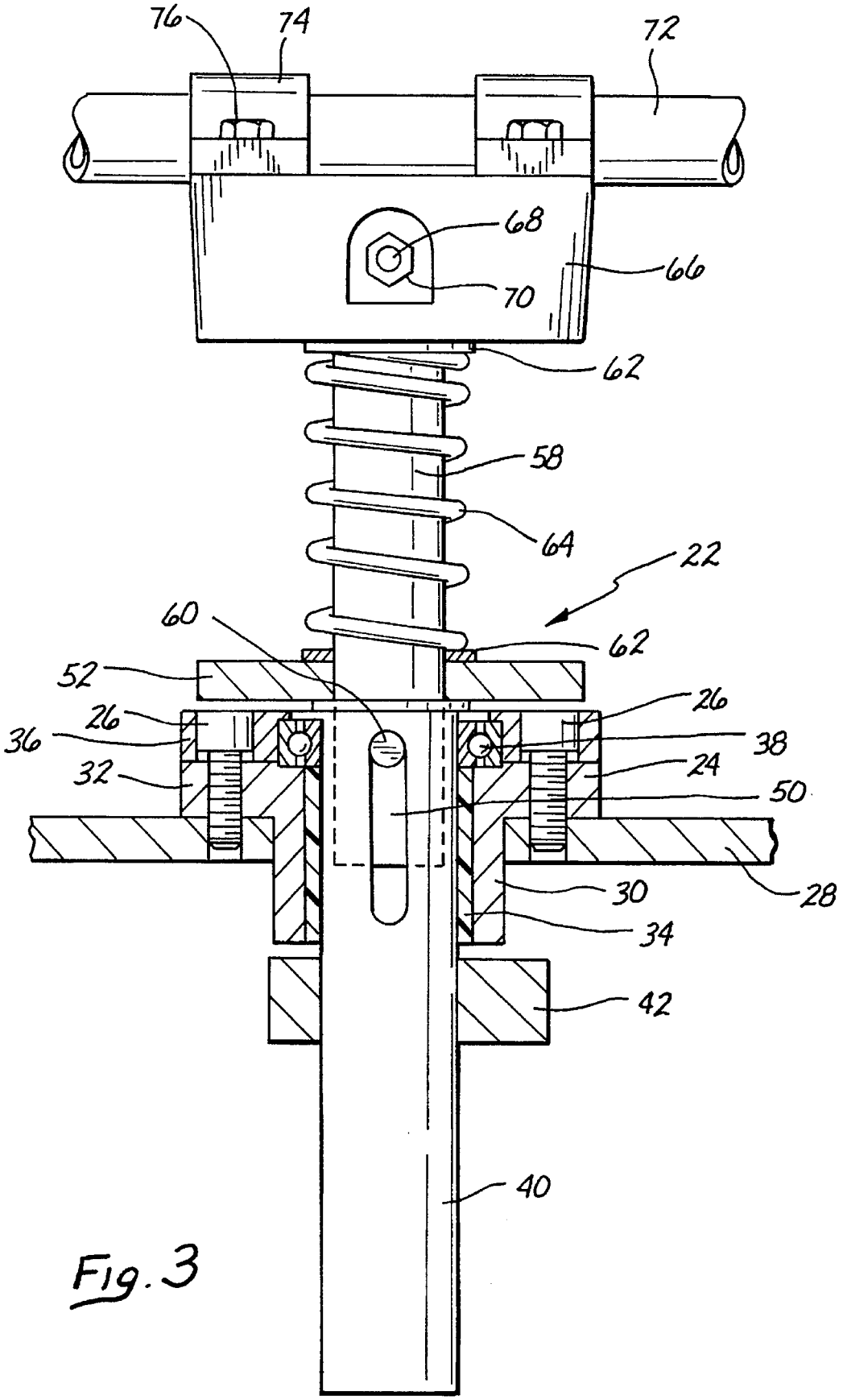
FIG. 3 is a cross-sectional view taken on lines 3,3 of FIG. 2.

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

As is noted in the background section of the present application for United States patent, personal watercraft are usually steered by a movable steering nozzle (not shown) mounted in the back of the watercraft below the waterline. A jet pump (not shown) driven by an internal combustion engine (not shown) ejects water through the nozzle (not shown) to drive and steer the watercraft. The positioning of the steering nozzle is controlled by a cable 20 which is in turn controlled by the rotational positioning of a set of handlebars. Thus, while driving the personal watercraft, an operator or rider holds the handlebars. When desiring to turn, or alter course of the watercraft the operator (not shown) turns the handlebars and thereby, through the cable 20, alters the positioning of the steering nozzle (not shown). Instead of a handlebar a steering wheel (not shown) may be provided in the personal watercraft, without substantially effecting the principle of operation of the steering assembly. The above described steering assembly and its principle of operation is conventional in the art, and therefore need not be shown in the drawing figures nor described in further detail. The invention described below provides an improvement in the steering assembly for personal watercrafts. As far as controlling the positioning of the steering nozzle (not shown) is concerned the present improvement operates in the above-described, conventional manner, but as a novel feature it absorbs the shock and bumps created while the watercraft travels on water. Therefore the present invention significantly increases riding comfort and reduces operator fatigue.

Referring now to FIGS. 1–5 of the drawing figures a first preferred embodiment 22 of the improved steering assembly for personal watercraft is disclosed. The steering assembly includes a member 24 that is fixedly mounted to the deck of the watercraft with a number of bolts 26. A portion of the deck to which the member 24 is mounted is shown on FIGS. 2 and 3 and bears the reference numeral 28. The bolts 26 are shown on FIG. 3. The member 24 fixedly mounted to the deck 28 acts as bearing carrier or bearing mount and is hereinafter sometimes referred to as such. As is best shown on FIG. 3, the bearing mount 24 has a hollow cylindrical body 30 and a disc 32 of larger diameter which is concentrically disposed with the cylindrical body 30. A cylindrical bushing 34 consisting of tetrafluoroethylene (TEFLON) or other suitable material is disposed within the cylindrical hollow interior of the bearing mount 24. In the first preferred embodiment 22 the bearing mount 24 further includes a bearing cap 36 which is fixedly attached to the bearing mount 24 by the same bolts 26 that attach the bearing mount 24 to the deck 28. A ball bearing 38 is retained between the bearing mount 24 and the bearing cap 36. An elongated cylindrical steering shaft 40 is fitted within the ball bearing 38 and the cylindrical bushing 34. It should be readily apparent from the foregoing description and the drawing figures that the steering shaft 40 is rotatable relative to the deck 28 within the bushing 34 and bearing 38.

A collar 42 attached to a bracket 44 is positioned on the steering shaft 40 below the cylindrical body 30 of the bearing mount 24. The cable 20 leading to the steering nozzle (not shown) is attached to the bracket 44. The collar 42 that holds the bracket 44 is affixed to the steering shaft 40 with a bolt 46 that is placed in a transverse hole in the steering shaft 40, and is secured by a lock nut 48. This is best shown on FIG. 5.

The upper portion of the steering shaft 40 is hollow and has two oppositely disposed and axially aligned openings 50 within the hollow portion. A collar 52 having a cut-out portion 54 is affixed to the upper end of the shaft 40 to rotate therewith. The cut-out portion 54 of the collar 52 accommodates a stop pin 56 which is affixed to the upper surface of the bearing cap 36. The interfacing cut-out portion 54 of the collar 52 and the stop pin 56 attached to the bearing cap 36 limit the pivoting motion of the steering shaft 40, so as to prevent over-steering of the personal watercraft.

The first preferred embodiment 22 of the steering assembly further includes an upper steering shaft 58 that is fitted within the upper hollow interior of the steering shaft 40. Two guide pins 60 are affixed to the upper steering shaft 58 with each one disposed within one of the axially aligned openings 50 of the steering shaft 40. One of the guide pins 60 is shown on FIG. 3. The guide pins 60 limit the downward telescoping movement of the upper steering shaft 58 within the lower steering shaft 40, and also prevent the upper steering shaft 58 from being pulled out from within the lower steering shaft 40. A washer 62 is disposed on the upper steering shaft 58 above the collar 52 and a coil spring 64 is placed on the shaft 58 above the washer 62. There is another washer 62 above the coil spring 64, and a handlebar mounting block 66 is affixed to the upper steering shaft 58 above the coil spring 64 and washer 62. The handlebar mounting block 66 is mounted to the shaft 58 with a bolt 68 placed into a transverse hole in the shaft 58, and secured by a lock nut 70. The handlebars 72 which are held by the operator/rider (not shown) of the watercraft are only partially shown in the drawing figures. They are affixed to the handlebar mounting block 66 with clamps 74 held to the block 66 with bolts 76.

Operation of the improved shock absorbing steering assembly should be readily apparent to those skilled in the art from the foregoing description and the drawing figures. Thus, the handlebars 72 are rotatable within the limits allowed by the interfacing collar 52 and the stop pin 56 to allow steering of the watercraft. The handlebars 72, together with the upper steering shaft 58, are also capable of limited telescoping, up-and-down motion relative to the bearing mount 24 and the deck 28, but this motion is tempered by the coil spring 64 which acts as a shock absorber, and substantially insulates the rider/operator from the shocks and bumps caused by riding over waves. The steering assembly of the present invention renders travel on the personal watercraft much more comfortable and less fatiguing than riding in a personal watercraft of the prior art, that is without shock absorbing steering.

Figure 6:
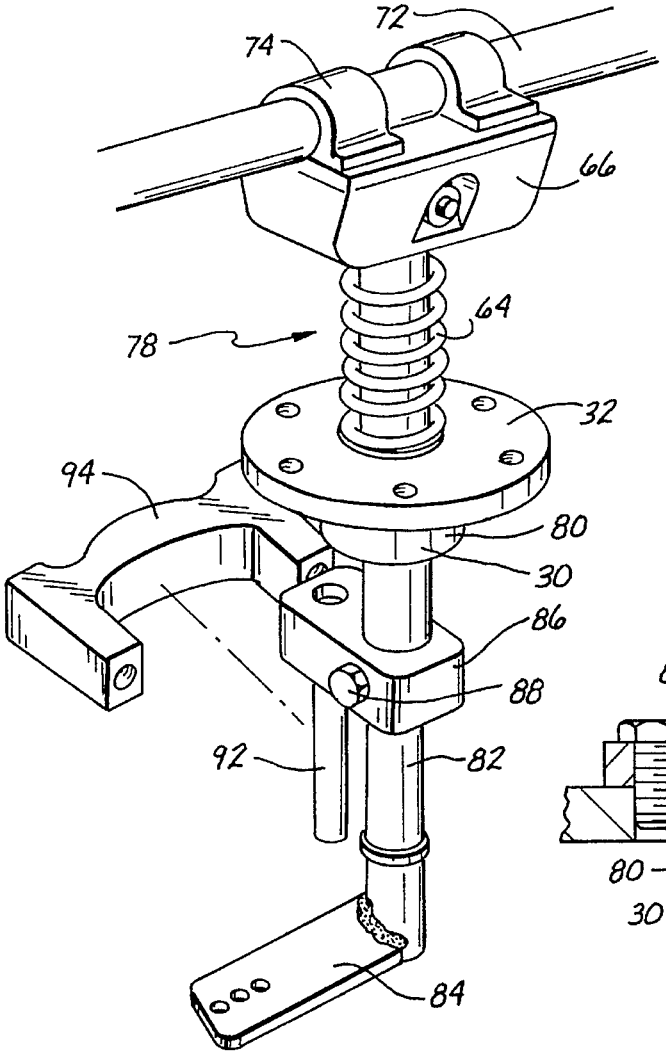
FIG. 6 is a perspective view showing the second preferred embodiment of the steering assembly of the present invention.
Figure 7:
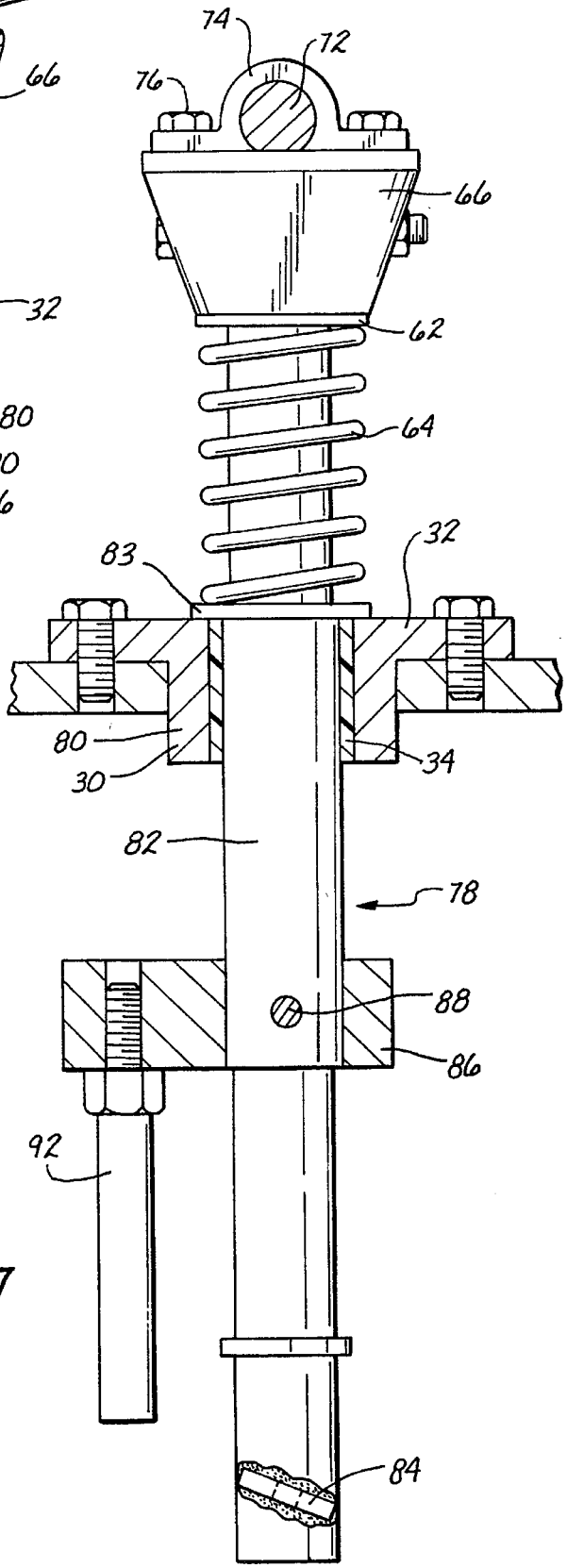
FIG. 7 is a side view, partly in cross section, of the second preferred embodiment.

FIGS. 6 and 7 disclose a second preferred embodiment 78 of the improved shock absorbing steering assembly of the present invention. In this embodiment a bearing or bushing mount 80, like the bearing mount 24 of the first preferred embodiment 22, includes a hollow cylindrical body 30 and a disc 32 of larger diameter. The disc 32 is attached to the deck 28 with bolts 26. A tetrafluoroethylene or like cylindrical bushing 34 is disposed within the cylindrical interior of the bushing mount 80. An elongated steering shaft 82 is mounted within the bushing 34 and is rotatable therein. A steering bracket or steering arm 84 is affixed to the steering shaft 82, in this embodiment, by welding. A cable (not shown for this embodiment) 20 leading to the steering nozzle (not shown) is affixed to the steering arm 84. Above the bushing mount 80 the steering shaft 82 includes a shoulder 83. A coil spring 64 is located above the shoulder 83 and above the coil spring 64 there is a washer 62. The handlebar mounting block 66 and the handlebars 72 are attached to the top of the steering shaft 82 above the second washer 62 in a manner similar to the first preferred embodiment 22. Below the bushing mount 80 a steering stopping block 86 is mounted to the steering shaft 82 with a bolt 88 placed into a transverse aperture in the shaft 82, and the bolt 88 is secured with a lock nut (not shown). A pin 92 is attached to the stopping block 86 and is disposed substantially vertically in the assembled structure. A steering stop bracket 94 is mounted to the deck 28 to interface with the pin 92 and thereby limit the rotational movement of the steering shaft 82.

Operation of the second preferred embodiment 78 should also be readily apparent from the foregoing description and drawing figures. An operator/rider (not shown) turns the handlebars 72 to rotate the steering shaft 82 within the limits allowed by the pin 92 and steering stop bracket 94. The steering shaft 82 is also capable of limited up-and-down motion relative to the bushing mount 80 and deck 28, and this motion is cushioned by the coil spring 64, whereby the operator/rider (not shown) is protected from the shocks and bumps caused by travel on rough water.

Figure 8:
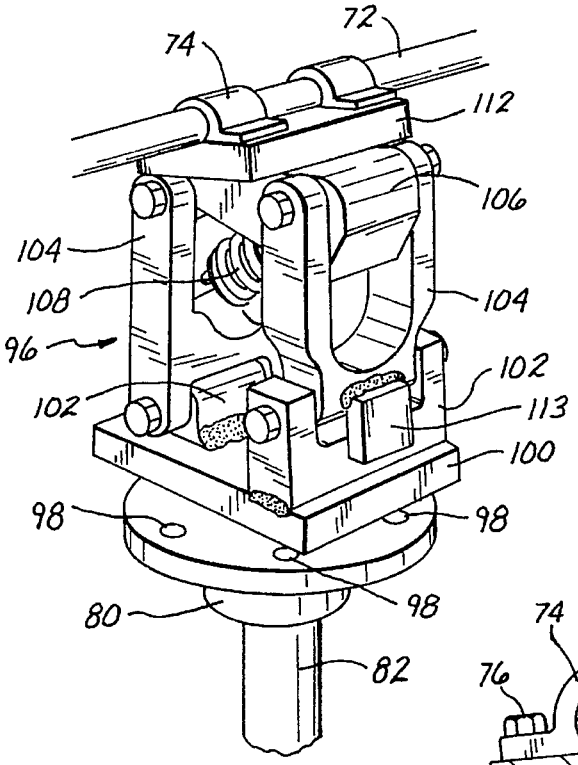
FIG. 8 is a partial perspective view showing the third preferred embodiment of the steering assembly of the present invention.
Figure 9:
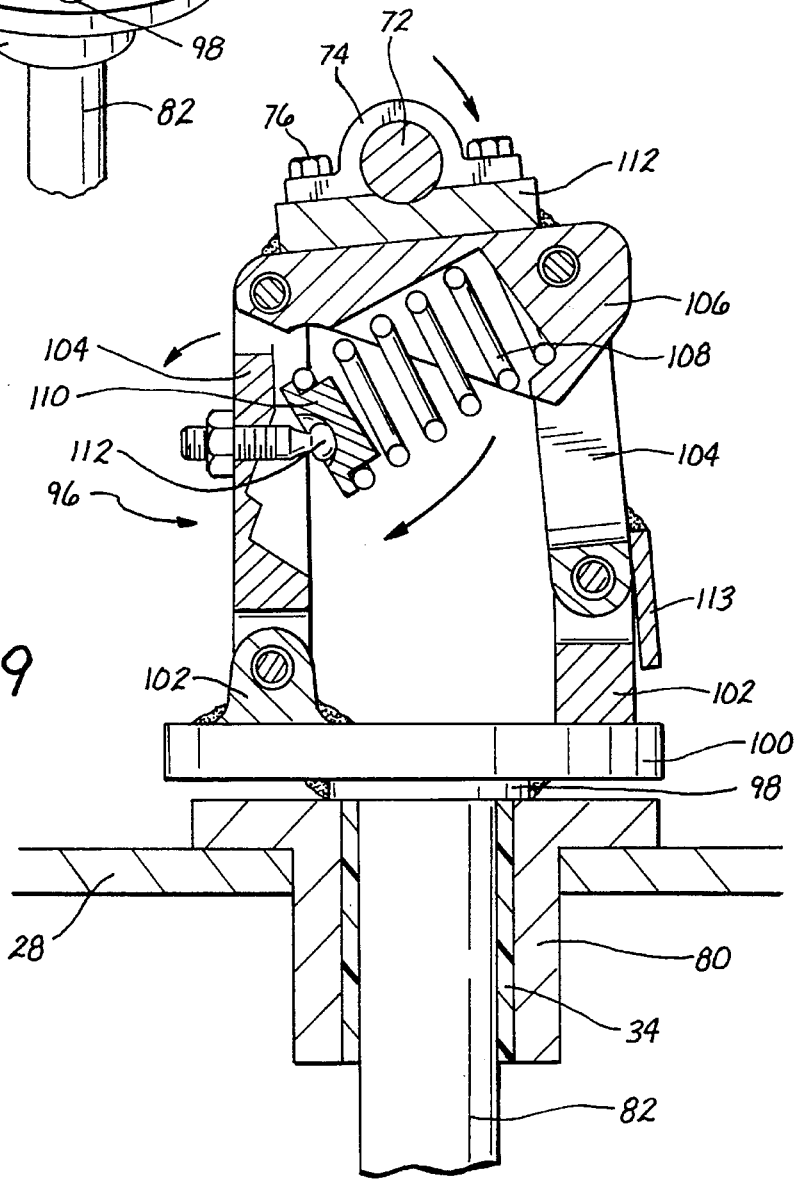
FIG. 9 is a partial side view, partly in cross section, of the third preferred embodiment.

Referring now to FIGS. 8 and 9, a third preferred embodiment 96 of the steering assembly is disclosed. This embodiment also includes a bushing mount 80 which is affixed by bolts and nuts (or by other suitable means) to the deck 28. FIG. 8 shows the apertures 98 in the bushing mount 80 which receive the bolts that attach the bushing mount 80 to the deck 28, but the bolts are not shown in FIGS. 8 and 9. As in the second preferred embodiment 78, the bushing mount 80 receives a TEFLON or like bushing 34 and a steering shaft 82 is placed in the bushing 34. A steering arm of the same type as in the second preferred embodiment 78 is attached at the bottom of the steering shaft 82, although the steering arm and the attached cable of this embodiment are not shown in the partial views of FIGS. 8 and 9. The steering shaft 82 includes a disc 98 welded to its upper end. A plate 100 having two bases 102 for hingedly mounted upright forks 104 is welded to the disc 98. The upright forks 104 carry a horizontal member 106 that is hingedly mounted to each fork 104. The horizontal member 106 has a substantially triangular side view and a hollow interior into which a coil spring 108 is mounted so that the coil spring 108 is disposed diagonally. A second (lower) end of the coil spring 108 retains a cup 110 which is supported by a pin 112 attached to one of the forks 104. A handlebar mounting plate 112 is attached by welding (or other suitable means) to the horizontal member 106. The handlebars 72 are attached to the mounting plate 72 with clamps 74 in a manner similar to the attachment of the handlebars 72 to the mounting block 66 in the first and second preferred embodiments. It should be readily apparent from the foregoing description and drawing figures that turning the handlebars 72 turns the steering shaft 82 and the steering arm (not shown for this embodiment). Bumps and jolts experienced by the watercraft while riding on rough water are cushioned by the above described structure, and specifically by the coil spring 108 which permits limited up-and-down motion of the handlebars 72 in the direction indicated by the arrows on FIG. 9. A block 113 welded to one of the forks 104 prevents disengagement of the coil spring 108 from the pin 112.

A fourth preferred embodiment 114 of the shock absorbing steering assembly of the present invention is disclosed by FIG. 10. The structure of the bushing mount 80, bushing 34, steering shaft 82 and steering arm (not shown for this embodiment), and their mounting to the deck 28 is similar to that of the third preferred embodiment 96. As is shown in FIG. 10, a substantially U-shaped bracket 116 is mounted to the top of the steering shaft 82, above the bushing mount 80. The U-shaped bracket 116 comprises two parts which are hingedly joined together so that the upper part 118 can pivot about an horizontal axis. The upper part 118 also serves as a mounting plate for attachment of the handlebars 72 with clamps 74 and bolts 76. The inner surface of each part of the U-shaped bracket 116 contains an indentation or cut out portion 120 into which a coil spring 122 is mounted. The coil spring 122 may be further secured by one or more pins (not shown). Operation of the fourth preferred embodiment 114 should also be readily apparent from the foregoing description and drawing figure. Turning the handlebars 72 turns the steering shaft 82 and steers the watercraft, while the limited up-and-down motion of the handlebars 72 is cushioned by the coil spring 122 and protects the rider/operator (not shown) from the shocks and bumps caused by traveling on rough water. Although this is not specifically shown for the third and fourth preferred embodiment, each of these embodiments can optionally be provided with means for limiting the pivoting motion of the steering shaft 82, so as to prevent over steering. This can be accomplished with a structure similar to the ones described for the first and second preferred embodiments.

Preferably in each of the herein described preferred embodiments of the shock absorbing steering assembly of the present invention, the coil springs utilized are progressive springs. As is known in the art a progressive spring is one in which increased compression of the spring requires increased force; in other words the force versus compression curve is not linear. Those skilled in the art will understand that whereas four preferred embodiments of the shock absorbing steering assembly of the present invention were described above, numerous variations and modifications are possible in light of the foregoing disclosure. For example, instead of a single spring a plurality of springs and parts to support the springs can be used in each of the embodiments. Also, coil springs are not the only means by which the force absorbing and up-and-down motion limiting functions of the present invention can be achieved. Instead of springs, or in addition thereto, hydraulic and pneumatic shock absorbers, and other shock absorbing devices known in the art, such as elastomers, can also be used in the invention. For these reasons, numerous modifications of the above-described embodiments may become readily apparent to those skilled in the art in light of the foregoing disclosure. Therefore, the scope of the present invention should be interpreted solely from the following claims, as such claims are read in light of the disclosure.

What is claimed is:

1. An improved steering assembly for a personal watercraft which includes a deck and a steering cable, the improved steering assembly comprising:

a first member adapted to be fixedly attached to the deck;

a steering shaft rotatably mounted to the first member and adapted to be attached to the steering cable;

handlebar means attached to the steering shaft and adapted to be gripped by a human operator of the personal watercraft and for turning the steering shaft, and shock absorbing means interposed between the first member and the handlebar means, for absorbing at least a portion of the force generated between the handlebar means and the first member, said shock absorbing means allowing the handlebar means to undergo up and down motion relative to the deck when the personal watercraft travels on water.

2. The improved steering assembly of claim 1 where the steering shaft is mounted in the first member.

3. The improved steering assembly of claim 2 where the shock absorbing means comprise a coil spring mounted on the steering shaft between the handlebar means and the first member.

4. The improved steering assembly of claim 3 further comprising bearing means interposed between the first member and the steering shaft to rotatably mount the steering shaft in the first member.

5. The improved steering assembly of claim 4 wherein the bearing means comprise ball bearings.

6. The improved steering assembly of claim 5 wherein the steering shaft comprises a first lower and a second upper shaft, the second upper shaft being mounted within the interior of the first lower shaft for up and down telescoping motion therein.

7. The improved steering assembly of claim 4 wherein the bearing means comprise a bushing affixed within the first member.

8. The improved steering assembly of claim 1 where the handlebar means are mounted to permit limited up-and-down motion of the handlebar means relative to the steering shaft.

9. The improved steering assembly of claim 8 where the shock absorbing means comprise a coil spring mounted between the handlebar means and an upper end of the steering shaft.

10. The improved steering assembly of claim 9 further comprising bearing means interposed between the first member and the steering shaft to rotatably mount the steering shaft in the first member.

11. The improved steering assembly of claim 10 wherein the bearing means comprise a bushing affixed within the first member.

12. An improved steering assembly for a personal watercraft which includes a deck and a steering cable, the improved steering assembly comprising:

a bearing retainer member adapted to be fixedly attached to the deck;

a bearing affixed within the bearing retainer member;

a steering shaft mounted to rotate within the bearing and capable of limited up and down motion within the bearing relative to the bearing retainer member and relative to the deck, said steering shaft being adapted to be attached to the steering cable;

handlebar means attached to the steering shaft and adapted to be gripped by a human operator of the personal watercraft and for turning the steering shaft, and shock absorbing means interposed between the bearing retainer member and the handlebar means, for absorbing at least a portion of the force generated between the handlebar means and the bearing retainer member said shock absorbing means allowing the limited up and down motion of the steering shaft when the personal watereraft travels on water.

13. The improved steering assembly of claim 12 where the shock absorbing means comprise a coil spring.

14. The improved steering assembly of claim 13 where the coil spring is mounted on the steering shaft above the bearing retainer member and below the handlebar means.

15. The improved steering assembly of claim 14 where the steering shaft comprises a first lower and a second upper shaft, the second upper shaft being mounted within the interior of the first lower shaft for up and down telescoping motion therein.

16. The improved steering assembly of claim 15 where the bearing is a ball bearing.

17. The improved steering assembly of claim 14 where the bearing comprises a bushing.

18. The improved steering assembly of claim 12 further comprising means for limiting the rotation of the steering shaft, whereby over-steering of the watercraft can be avoided.

19. An improved steering assembly for a personal watercraft which includes a deck and a steering cable, the improved steering assembly comprising:

a bearing retainer member adapted to be fixedly attached to the deck;

a bearing affixed within the bearing retainer member;

a steering shaft mounted to rotate within the bearing and adapted to be mounted to the steering cable;

handlebar means attached to the steering shaft and adapted to be gripped by a human operator of the personal watercraft and for turning the steering shaft, and shock absorbing means interposed between the steering shaft and the handlebar means, for absorbing at least a portion of the force generated between the handlebar means and the steering shaft when the personal watercraft travels on water and the steering shaft moves up and down relative to the handlebar means.

20. The improved steering assembly of claim 19 where the shock absorbing means comprise a coil spring.

21. The improved steering assembly of claim 20 further comprising means for mounting the handlebar means on a lever capable of limited pivoting motion about a horizontal axis, and wherein the coil spring of the shock absorbing means is mounted for tempering the pivoting motion of the handlebar means about the horizontal axis.

22. The improved steering assembly of claim 19 further comprising means for limiting the rotation of the steering shaft, whereby over steering of the watercraft can be avoided.

* * * * *